US005675355A

United States Patent [19]

Chiu et al.

[11] Patent Number: 5,675,355

[45] Date of Patent: Oct. 7, 1997

[54] AUTOMATED COHERENT CLOCK SYNTHESIS FOR MATRIX DISPLAY

[75] Inventors: Yue Tong David Chiu, Eatontown; Richard P. Tuttle, Wall, both of N.J.

[73] Assignee: The United States of America as represented by the Secretary of the Army, Washington, D.C.

[21] Appl. No.: 666,720

[22] Filed: Jun. 18, 1996

[51] Int. Cl.[6] ..... G09G 3/03

[52] U.S. Cl. ..... 345/99; 345/213; 348/464; 348/465; 348/467; 348/468; 348/510; 348/521; 348/522; 348/540

[58] Field of Search ..... 345/213, 99; 348/464, 348/465, 467, 468, 510, 521, 522, 540

[56] References Cited

U.S. PATENT DOCUMENTS

| | | | |
|---|---|---|---|
| 4,556,880 | 12/1985 | Hamada | 345/213 |
| 4,595,953 | 6/1986 | Willis | 358/183 |
| 4,626,837 | 12/1986 | Priestly | 345/213 |
| 4,893,175 | 1/1990 | Fukada | 358/12 |
| 5,115,232 | 5/1992 | Iizuka | 340/784 |
| 5,293,474 | 3/1994 | Patil et al. | 395/148 |
| 5,387,941 | 2/1995 | Montgomery et al. | 348/520 |
| 5,406,308 | 4/1995 | Shiki | 345/99 |
| 5,428,806 | 6/1995 | Pocrass | 395/800 |
| 5,450,122 | 9/1995 | Keene | 348/1 |
| 5,606,348 | 2/1997 | Chiu | 345/213 |

*Primary Examiner*—Richard Hjerpe
*Assistant Examiner*—Joseph Acosta
*Attorney, Agent, or Firm*—Michael Zelenka; William H. Anderson

[57] ABSTRACT

To interface a video/graphic controller, which produces conventional, analog video output signals, suitable mostly for CRT type displays, to a matrix display, one of the video output signals, for example the horizontal sync signal, is encoded with the clock frequency and phase information used in generating the original video output signals. The encoded information is decoded at the display end, by extracting from it the clock information and synthesizing a clock signal which has the identical frequency and phase as the original clock used at the video/graphic controller. The replicated clock signal is used as a clock input to the matrix display, to assure that the video output signals are displayed at the correct pixel locations of the matrix display, preventing picture jitter and/or loss of video/graphics data.

7 Claims, 3 Drawing Sheets

AUTOMATED COHERENT CLOCK SYNTHESIS FOR MATRIX DISPLAY

GOVERNMENT INTEREST

The invention described herein may be manufactured, used, imported and licensed by or for the Government of the United States of America without the payment to us of any royalties thereon.

FIELD OF THE INVENTION

This invention relates to electrical displays and, more particularly, to a method and circuitry which facilitates the interfacing of video signals generated by a graphic controller to a matrix display.

BACKGROUND OF THE INVENTION

The typical display output of a conventional computer is usually in analog form. The most common display output signals consist of three RGB (red, green and blue) data signals which are accompanied by a horizontal sync (HS) signal and a vertical sync (VS) signal. Another format consists of RGB signals with sync on green. These signals are intended mainly for CRT type, raster style monitor screens. They are not suitable for and/or compatible with most matrix displays.

The source of signal incompatibility is partially due to the fact that each picture pixel (picture element) in most matrix displays is defined as the intersection of row and column electrodes. In contrast, in CRT type monitor screens, continuous horizontal lines are defined by a scanning electron beam. Therefore, whereas each pixel on the matrix display is at a fixed location, a more loosely defined pixel location is defined on a CRT, where each pixel can be anywhere on a scanning row depending on where the electrons happen to hit the phosphor screen at the time, as dictated by the RGB data signals.

Matrix displays therefore require a higher precision control in the exact timing of the turning on and off of each picture element, i.e. pixel. This necessitates a very accurate clock signal having the exact frequency and phase that were used in the video/graphic source to generate the original RGB video data. Any deviation in frequency and phase can potentially result in undesirable visual artifacts such as discernible image jitter, as well as partial loss of display data on the matrix display.

CRT type displays are more tolerant to such deviations (to some degree), as the display jitter is not as discernible to the eye. Therefore, although a clock signal is used to generate the video information that is displayed on CRTs, the CRTs do not require the clock signal to reproduce the video images on the CRT screen.

Since conventional display devices are mostly of the CRT type, the clock signal is not usually supplied as part of the graphic controller output. One cannot just assume a particular clock frequency at the matrix display, since the frequency of the internally used clock at the source is not fixed but varies depending on different graphic modes of operation. In addition, there is no standard on many of the graphic modes; and different manufacturers use slightly different frequencies at different modes, resulting in a wide range of frequencies used by different graphic controllers.

To date, the prior art has failed to supply clock data together with conventional video signals, to enable matrix displays to more accurately and faithfully reproduce the original video data.

SUMMARY OF THE INVENTION

Accordingly, it is an object of the present invention to provide a method and circuitry which are capable of supplying to a matrix display clock information.

It is another object of the present invention to provide a simple and effective method for conveying clock information embedded in conventional video signals.

Another object of the present invention is to provide a matrix display which responds to conventional video signals to produce images which are free of discernible image jitter and which are substantially immune to loss of display data at the matrix display.

The foregoing and other objects of the present invention are realized with a system and method which automatically synthesizes a clock for a matrix display, which clock has a frequency and phase identical to that of the input clock.

The method of the present invention includes the steps of providing a conventional video output in the form of a plurality of video output signals associated with a raster type display, in which the video output signals define original images that are referenced to an input clock having a predetermined frequency and a predetermined phase. At least one of the video output signals is encoded with clock information which defines the frequency and the phase of the input clock, providing a clock-encoded video output signal. The video output including the clock-encoded video output signal are then transmitted to a display end which includes a clock decoding circuit. The clock decoding circuit produces a replicated clock signal which has the same frequency and phase as the original input clock signal. The replicated clock signal is then used, together with the conventional video output signals, to drive a matrix display which reproduces the original images.

In accordance with the one embodiment of the invention, the system hardware includes an encoder which receives one of the conventional video output signals together with the input clock to produce therefrom the clock-encoded video output signal. A decoding circuit at the display end receives the clock-encoded video output signal and produces therefrom a signal containing the clock information. A clock generating circuit responds to the decoding circuit to produce the replicated clock signal, which is then used to drive a matrix display to reproduce the original images. The circuitry for producing the replicated clock signal may include, in addition to the decoding circuit, a clock synthesizer circuit and a phase locked loop (PLL).

Other features and advantages of the present invention will become apparent from the following description of the invention which refers to the accompanying drawings.

DETAILED DESCRIPTION OF THE DRAWINGS

Figure 1:
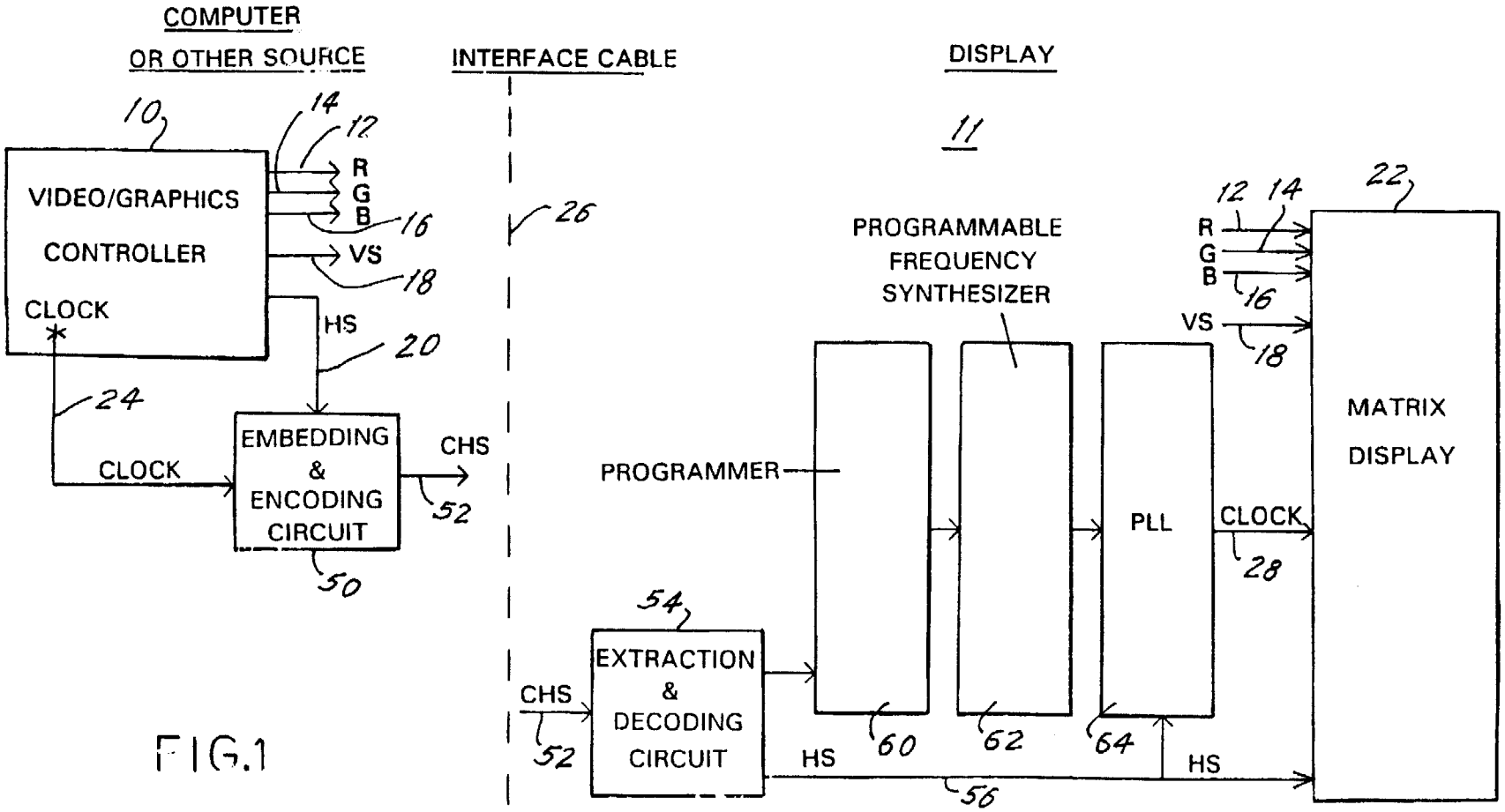
FIG. 1 is a block diagram of the present invention in accordance with a first embodiment thereof.

With reference to FIG. 1, a conventional video/graphics controller 10 produces conventional video output signals including a, red, green and blue (RGB) video signals 12, 14, 16, a vertical sync signal (VS) 18 and a horizontal sync signal (HS) 20. As well known in the art, these RGB, VS and HS signals are standard in the industry to drive and reproduce an original video image on a conventional, raster style CRT screen (not shown). The video images are recreated on the CRT screen without any discernible jitter and loss of data is not a problem.

This is not the case with the matrix display 22 which produces a video image by selective activation of a plurality of picture pixels which are arrayed as a matrix on the matrix display 22. The conventional approach is to drive such a matrix display 22 not only with the conventional RGB signals 12, 14, 16, the vertical sync VS 18 signal and the horizontal sync signal 20, but also with a clock signal which is needed to clock the video information into the correct pixel positions.

All current matrix display systems including the latest 1280×1024 color LCD (direct view and projection type) which accept signals from an external source such as the graphics controller output of a computer have one thing in common. They generate their timing clock with a frequency taken from a set of preprogrammed frequencies which may or may not match exactly the clock frequency and phase used at the external source which generated the original video images. This approach can result in the display image experiencing jitter and data loss. Alternatively, some conventional systems use a key pad through which the operator manually keys in an exact frequency number after the operator went through examining the graphic controller manuals or performed direct measurements taken inside the graphic source. This requires this procedure to be repeated with every change of graphic mode.

Thus, one can attempt to provide the clock information signal to the matrix display 22 which approximates the original clock signal 24 which was used in the video/graphics controller 10 to generate the video information. However, for the reasons noted above, this approach is not fully satisfactory, and likely to produce image jitter and/or cause data loss in the matrix display 22.

The circuit and method of the present invention addresses and solves the aforementioned problem with the system 11 illustrated in FIG. 1. Essentially, the system 11 conveys the clock frequency information defined at the clock output 24 of the video/graphics controller 10 to the matrix display 22, by encoding the clock information on one of the conventional video signals, e.g. as the RGB, HS and/or VS signals. The encoded clock information can then be used by any matrix display 22 to faithfully reproduced the original images.

The matrix display devices for which the present invention is intended includes displays of the type that have no built-in graphics generating capability, and which receive all their data and sync signals from an external source such as the output of a graphic controller 10 of a computer or the like. These types of matrix displays include FPDs (flat panel displays—i.e. LCD, EL, Plasma, FED, etc.).

As noted above, the clock information embedded in the conventional video signals is later extracted at the display end (located to the right of the interface cable 26 in FIG. 1) to generate a replicated clock signal 28 which is inputted to and used to drive the matrix display 22. The key is that the clock signal 28 has a frequency and a phase which exactly match the corresponding frequency and phase of the clock output 24 of the video/graphic controller 10.

The novel display system illustrated in FIG. 1 departs from the prior art by providing, among other things, an embedding and encoding circuit 50 which receives one (or more) of the conventional video signals, in the illustrated example, the horizontal sync signal 20, and encodes or modulates it with the clock information received from the video/graphic controller clock output 24. The encoding circuit 50 produces a clock-encoded horizontal sync signal 52 which is supplied via the interface cable 26 to an extraction and decoding circuit 54, which receives the clock-encoded horizontal sync signal 52 and produces from it a reconstituted horizontal sync signal 56 which is free of the clock information and thus supplied to the matrix display 22.

The decoding circuit 54 also extracts a clock information signal 58 which is provided to a programmer 60. The programmer 60 is coupled to a programmable frequency synthesizer 62 which is in turn coupled to a PLL (phase locked loop) 64. The circuit elements 60, 62 and 64 use the clock information signal 58 to produce the replicated clock 28, which has the same frequency and phase as the original clock signal 24 used in the video graphic controller 10.

While FIG. 1 shows the frequency information being embedding into the horizontal sync signal 20, this is only one of many possible ways where the clock information can be embedded. For example, the information can be embedded at different locations in the horizontal sync, different locations in the vertical sync signal, as well as in any of the RGB data lines 12, 14 and 16. The invention covers all possible implementations, as long as it is compatible with the method used at the display end, so that the display end knows where to look for the clock information.

There are a variety of ways to embed the information into the selected signal. One way is to encode it digitally using binary encoding. For example, if the frequency is 155.147 MHz, it can be represented by its binary equivalent of 1 0 0 1 1 0 1 1 1 0 0 1 0 0 1 1, with the left eight bits representing the value to the left of the decimal point (i.e., 10011011=155) and the right eight bits representing the value to the right of the decimal point (i.e. 10010011=147). If desired, more bits can be used to obtain greater resolution, i.e. higher accuracy.

Figure 2:
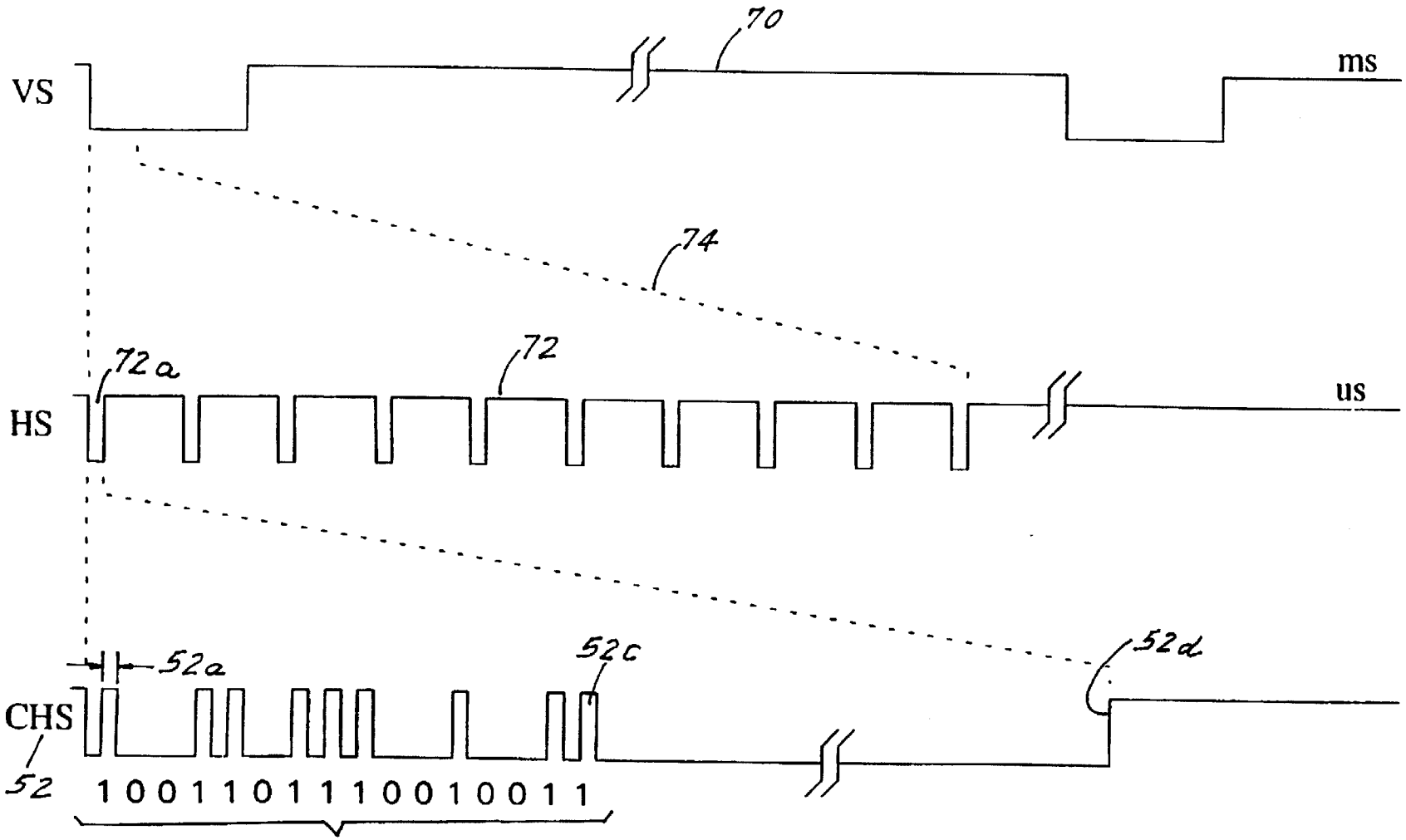
FIG. 2 depicts video signal waveforms which have been encoded with clock information.

FIG. 2 shows a particular vertical sync signal 70 aligned with a particular conventional horizontal sync signal 72. It illustrates that during one pulse duration of the vertical sync there occur a plurality of horizontal sync pulses as is well known and indicated by the dotted line 74.

In accordance with the present invention, the clock-encoded horizontal sync signal 52 is shown in FIG. 2 for the case where the pulse **72*a* of the horizontal sync signal 72 has been encoded with the code 1 0 0 1 1 0 1 1 1 0 0 1 0 0 1 1, representing the aforementioned 155.147 MHz clock signal. The bit duration and the time interval 52*a* between each bit of the encoded data 52*b* must be pre-determined, since the display 22 must use the same information to find and decode the binary encoded information. In addition, the time interval and bit duration must be chosen in such a way that the last bit 52*c* ends before the occurrence of the next transition time 52*d* on the horizontal sync signal 72**, to assure that the whole process is completed within one horizontal sync time period.

Again, different methods can be used for the encoding processes. The key point to appreciate here is that the instant invention is intended to cover all encoding schemes, as long as the methods are compatible at both ends so that the display 22 can properly decode the encoded information.

Referring back to FIG. 1, the programmer 60 uses the extracted/decoded information signal 58 to generate a series of commands to the programmable frequency synthesizer 62 to program and synthesize a clock signal with the frequency as defined in the information extracted. The clock signal is then phase locked with the horizontal, sync in the phase locked loop (PLL) 64 to produce the output clock 28 having the exact same frequency and phase as that used in the video/graphic source 10, i.e. the clock output 24.

Figure 3:
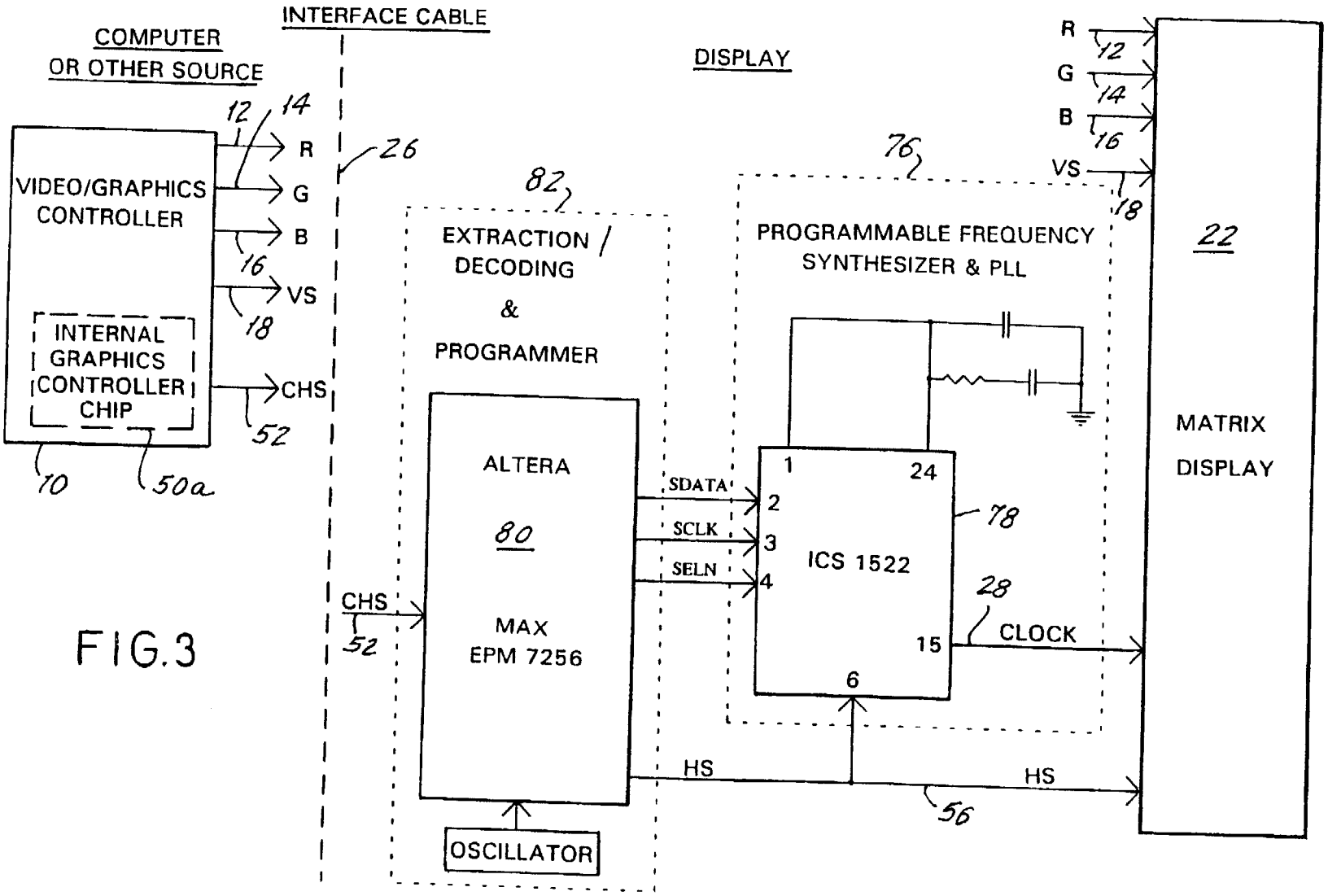
FIG. 3 is a block diagram of a more detailed embodiment of the present invention.

A possible circuit implementation is illustrated in FIG. 3 in which a circuit block 76, forming the programmable frequency synthesizer 62 and PLL 64 of FIG. 1, is constituted of an ICS 1522 integrated circuit 78 which is available from Integrated Circuit Systems, Inc. AMAX EPM 7256 integrated circuit 80 that is available from the Altera Corp. is used for realizing a circuit block 82 which comprises the extraction and decoding circuit 54 and programmer 60 of FIG. 1.

It is also preferred to have all of the embedding and encoding performed inside the graphic controller chip at the source, for example with an internal graphic controller chip 58 (FIG. 3) which may similarly be implemented with commercially available integrated circuits.

Although the present invention has been described above in relation to particular embodiments thereof, it should be readily apparent to the person of ordinary skill in the art that there are numerous ways in which this invention can be implemented. This includes but is not limited to how the frequency information is coded, where it is being embedded, how it is extracted and decoded, how it is used to synthesize the clock, how it is phase-locked, etc. What is of significance here is the disclosure of an overall scheme and method of conveying the clock frequency information from a display source, such as a video/graphics controller 10, to a matrix display 22 using existing video signal lines, so that the receiving display 22 knows exactly the frequency of the clock signals used in the source. Based on this information, the display 22 can then automatically synthesize a clock having the exact frequency and phase. Thereby, the video data signals can be directed correctly to each pixel on the matrix display.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for generating a clock signal for a matrix type display, from signals provided by a graphics source, comprising the steps of:

providing a video output in the form of a plurality of video output signals associated with a raster type display, in which the video output signals define original images that are referenced to an input clock having a predetermined frequency and a predetermined phase;

encoding at least one of the video output signals with clock information which define the frequency and the phase of the input clock to provide a clock-encoded video output signal;

transmitting the clock-encoded video output signal to a display which includes a clock decoding circuit;

supplying the clock-encoded video output signal to the clock decoding circuit and producing a replicated clock signal having said predetermined frequency and said predetermined phase; and supplying said replicated clock signal and said plurality of video output signals to said matrix type display and reproducing therewith said original images;

providing an extraction and decoding circuit and producing therewith a reconstituted version of at least one of said video signals free of said clock information; and using a phase locked loop which is coupled to the reconstituted horizontal sync signal and which responds to another signal to produce the replicated clock signal;

wherein the plurality of video output signals include RGB video signals, a vertical sync signal and a horizontal sync signal; and wherein the clock information is encoded within one signal period of the horizontal sync signal.

2. The method of claim 1, including encoding the clock information in binary format.

3. A system for generating a clock signal for a matrix type display, from signals provided by a graphic source, comprising:

an interface for receiving a video output in the form of a plurality of video output signals associated with a raster type display, in which the video output signals define original images that are referenced to an input clock having a predetermined frequency and a predetermined phase, wherein at least one of the video output signal is encoded with clock information which define the clock frequency and phase of the input clock to provide a clock-encoded video output signal;

a decoding circuit for receiving the clock-encoded video output signal and for producing therefrom a signal containing said clock information;

a clock generating circuit responsive to the decoding circuit for producing a replicated clock signal having said predetermined frequency and said predetermined phase, wherein the clock generating circuit comprises a phase locked loop; and a matrix display responsive to said plurality of video output signals and to said replicated clock signal for reproducing said original images.

4. The system of claim 3, in which the decoding circuit includes means for reproducing the at least one of the video output signals as a reconstituted signal, in a form in which the clock information has been removed therefrom.

5. The system of claim 3, in which the phase locked loop is coupled with and is responsive to at least one of the reconstituted video output signals.

6. The system of claim 3, in which the decoding circuit is connected to a programmer circuit, the programmer circuit is connected with a programmable frequency synthesizer, and the programmable frequency synthesizer produces an intermediate clock signal which is supplied to the phase locked loop.

7. The system of claim 3, further comprising an encoding circuit for receiving the input clock and the at least one video output signal and for producing therefrom said clock encoded video output signal.

* * * * *